US005727687A

United States Patent [19]

Renner

[11] Patent Number: 5,727,687

[45] Date of Patent: Mar. 17, 1998

[54] PACKAGE FOR GOODS IN PELLETS

[75] Inventor: Klaus Renner, Ettlingen, Germany

[73] Assignee: Klocke Verpackungs Service GmbH

[21] Appl. No.: 582,990

[22] PCT Filed: Jul. 8, 1994

[86] PCT No.: PCT/DE94/00793

§ 371 Date: Jan. 18, 1996

§ 102(e) Date: Jan. 18, 1996

[87] PCT Pub. No.: WO95/03230

PCT Pub. Date: Feb. 2, 1995

[30] Foreign Application Priority Data

Jul. 26, 1993 [DE] Germany ..... 93 11 121 U
Sep. 2, 1993 [DE] Germany ..... 93 13 193 U

[51] Int. Cl.[6] ..... B65B 83/04

[52] U.S. Cl. ..... 206/532; 206/538

[58] Field of Search ..... 220/359, 268, 220/270; 206/467, 469, 470, 528, 532, 538

[56] References Cited

U.S. PATENT DOCUMENTS

| | | | |
|---|---|---|---|
| 3,184,319 | 5/1965 | Fritsche . | |
| 4,537,312 | 8/1985 | Intini | 206/532 X |
| 4,721,204 | 1/1988 | Shee . | |
| 5,125,529 | 6/1992 | Torterotot | 220/270 |
| 5,199,745 | 4/1993 | Balsamo | 206/469 X |
| 5,339,960 | 8/1994 | Price | 206/532 X |

FOREIGN PATENT DOCUMENTS

| | | |
|---|---|---|
| 52 534 | 1/1966 | Germany . |
| 88 10 948 | 11/1986 | Germany . |
| 88 11 941.6 | 3/1989 | Germany . |

*Primary Examiner*—Jacob K. Ackun
*Attorney, Agent, or Firm*—Loeb & Loeb LLP

[57] ABSTRACT

Packaging for storing products in the form of pellets, the packaging including a deep-drawn element having a plurality of straight deep-drawn grooves, each groove having an open top and being dimensioned to hold a plurality of the products in a row, and a cover element covering the deep-drawn element and the open tops of the grooves, the cover element having a plurality of closable removal openings each aligned with a portion of the open top of a respective one of the grooves, each closable removal opening being openable for removal of successive ones of the products held in the respective one of the grooves. The cover element is composed of a cover foil provided with a plurality of flaps, each of the flaps delimiting a respective one of the removal openings, and each of the flaps being surrounded by a respective portion of the cover foil, and an adhesive foil, having a plurality of portions, each of the adhesive foil portions covering, and secured to, a respective one of the flaps and covering the respective portion of the cover foil which surrounds the respective one of the flaps, each of the adhesive foil portions being movable between a closing position for causing the adhesive foil portion and the respective one of the flaps to tightly seal the respective one of the removal openings and an opening position for opening the respective one of the removal openings.

7 Claims, 2 Drawing Sheets

FIG. 5
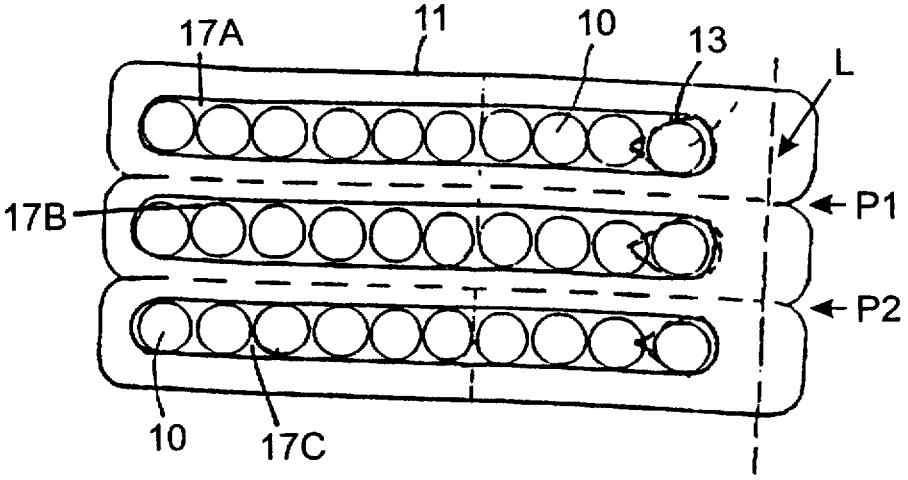
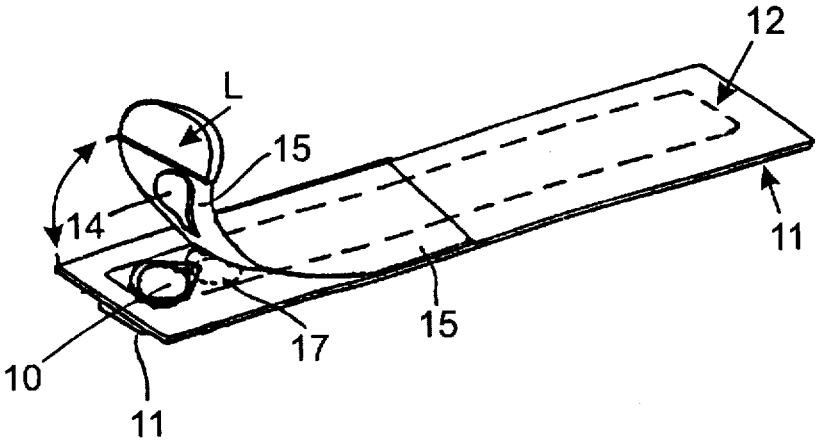
FIG. 4

PACKAGE FOR GOODS IN PELLETS

TECHNICAL FIELD

The invention relates to packaging for pellet-shaped products, consisting of a deep-drawn element for receiving the products and a cover foil.

A deep-drawn push-through package for tablets for the purposeful removal of individual products is commercially widely distributed, wherein the deep-drawn element has a number of individual wells for receiving the tablets corresponding to the number of tablets. The push-through foil is provided with a metal foil as the cover element or a composite aluminum-metal foil and its strength is of such a size that the tablet is pushed out by pressure from the bottom toward the top on the deep-drawn well. Because of the employment of different materials for the deep-drawn foil or the cover foil, recycling of the package is possible only if the separation of the materials is performed more or less laboriously by the end user which, as experience has shown, is not the case at least right now. In addition, the arrangement of individual wells is very expensive from a material point of view if the ratio of the number of products to the packaging material is taken into consideration.

A further disadvantage of this packaging lies in that the often printed cover foil is inevitably further destroyed every time tablets are removed and the information thereon is no longer legible and therefore is useless for passing on further information regarding the respective pharmaceutical product.

PRIOR ART

U.S. Pat. No. 4,721,204 shows a packaging in accordance with the species. It is used for a magazine-like receptacle of ampuls; the cardboard cover element at one package end is embodied flap-like for opening and closing the deep-drawn element. By flipping the protruding edge of the cover element over (identified as support element), the removal opening can at least be closed again to such an extent that the remaining ampuls are secure against falling out. This "mechanical" reclosing is sufficient here, because the required sealing measures regarding the pharmaceutical active ingredient are provided by the ampuls. This packaging cannot be used for other, solid presentations of pharmaceutical articles, such as tablets, since the packaging, once opened, no longer assures a sufficient seal against dust and moisture and since the pharmaceutical effect and/or the stability of the preparation can be impaired.

This, too, is a multi-material package with the disposal problems already indicated above.

Packaging with a flap for removing the products through a removal opening and with an adhesive foil extending over the flap and at least a portion of the adjoining surface of the packaging in such a way that the removal opening can be reclosed by means of the flap, is known from DE-U-88 10 948. The packaging shown there consists of a deep-drawn element and a sealed-on cover foil, wherein the said removal opening is provided in the deep-drawn element. Since several of the pellet-shaped products, for example candy or tablets, are present without any order in the deep-drawn element, the controlled removal of the products from such packaging is not possible. With the technology used, these packagings are also made of different materials, in particular a plastic deep-drawn element and a mostly metallic cover foil and first require the separation of these materials before recycling is possible.

DE-U-88 11 951.3 shows a blister pack for small objects, for example tablets, wherein the cover foil extends strip-like over the individual wells and also consists of a metal foil, something which does not remove the problem of disposal. To be able to achieve reclosing of individual wells, places free of adhesive are provided in this area, and the adhesive for connecting the deep-drawn element with the cover foil is intended to reusable.

This solution does not materially reduce the material outlay, but increases the production outlay, since it is necessary to produce the adhesive-free portion of the strips of the cover foil in a precise manner and to glue them in the exact positions on the deep-drawn element. Thus this packaging does not offer any essential advantage over the packaging mentioned at the outset and introduced in the marketplace, and up to now has therefore not been successful.

A further type of packages is characterized by way of example by DD-A-52534, wherein a plurality of tablets are housed in a helical row in a fairly elaborate dispenser, from which they can be individually taken one after the other. In this case the dispenser is embodied as an upper part and a lower part which are obviously injection-molded or cast and are therefore very expensive from a material point of view.

In an overall view of the known technology it becomes clear that a simple and material-saving production, improvement of recyclability and a high utility value along with successive individual removal of the packages products could not be satisfactorily realized up to now.

REPRESENTATION OF THE INVENTION

It is the object of the invention to further develop the packaging in accordance with the species in such a way that it is suitable for packaging pharmaceutical articles in the form of tablets, coated pills or capsules and avoids the mentioned disadvantages.

This object is attained in accordance with the invention in that the cover element is formed by a cover foil in which a flap has been cut for forming the removal opening, and that an adhesive foil extends over the flap and at least a portion of the adjoining surface of the packaging in such a way that the removal opening with the flap can be tightly sealed again in connection with articles in solid pharmaceutical presentations, such as tablets.

The basic concept of the invention consists in respect to the known packaging in the arrangement of the flap in the cover foil; simple opening and simple reclosing by means of the adhesive foil of the packaging is assured by this step and the deep-drawn element, the cover foil and the adhesive foil can all be produced from plastic materials and in this way recycled as single-material packaging.

The requirements of the pharmaceutical industry regarding the sealing of the packaging can also be assured without problems.

Since the cover foil of the packaging is not destroyed (as in the known push-through package for tablets) during continuing consumption of the package contents, the cover foil can now also be used as an information provider (suggestions for use, statement of the contents), because of which it might be possible to omit additional precautions or to simplify the package insert.

In accordance with an embodiment of the invention the products, i.e. tablets in particular, are received in rows in the groove-like embodied deep-drawn element, so that a sort of magazine is formed in which a defined number of tablets can be stored and successively removed through the definedly disposed removal opening.

The flap is suitably located over the end of a deep-drawn groove, which assures a further simple design of the invention, namely the formation of an opening tongue consisting on the one hand of an end section of the adhesive foil and a separable edge section of the deep-drawn element.

Further embodiments of the invention ensue from the dependent claims.

Very tight compact packaging in contrast to the known solutions with comparable sealing properties by the use of separate deep-drawn wells is achieved by means of the magazine-like arrangement of the pharmaceutical articles, such as tablets. It is possible by means of this to reduce the total material use considerably, for example, it is possible to achieve a savings in foil in the range of 40% and a reduction in size of the wrapping and shipping containers (fold boxes, etc.), which results in considerable cost savings, on the one hand because of the material savings connected therewith, on the other hand because of a reduction in the storage and transport spaces. It goes without saying that the disposal problem in connection with the packaging as well as the wrappings is considerably reduced, since the novel packaging can be also produced as a "single-material packaging" for all practical purposes.

An exemplary embodiment of the packaging in accordance with the invention will be explained in what follows, making reference to the drawings.

BRIEF DESCRIPTION OF THE DRAWINGS

FIG. 4 is a perspective view of the total packaging in the opened state, and FIG. 5 is a schematic view of a further variant of the packaging with several deep-drawn grooves.

DESCRIPTION OF AN EXEMPLARY EMBODIMENT

Figure 1:
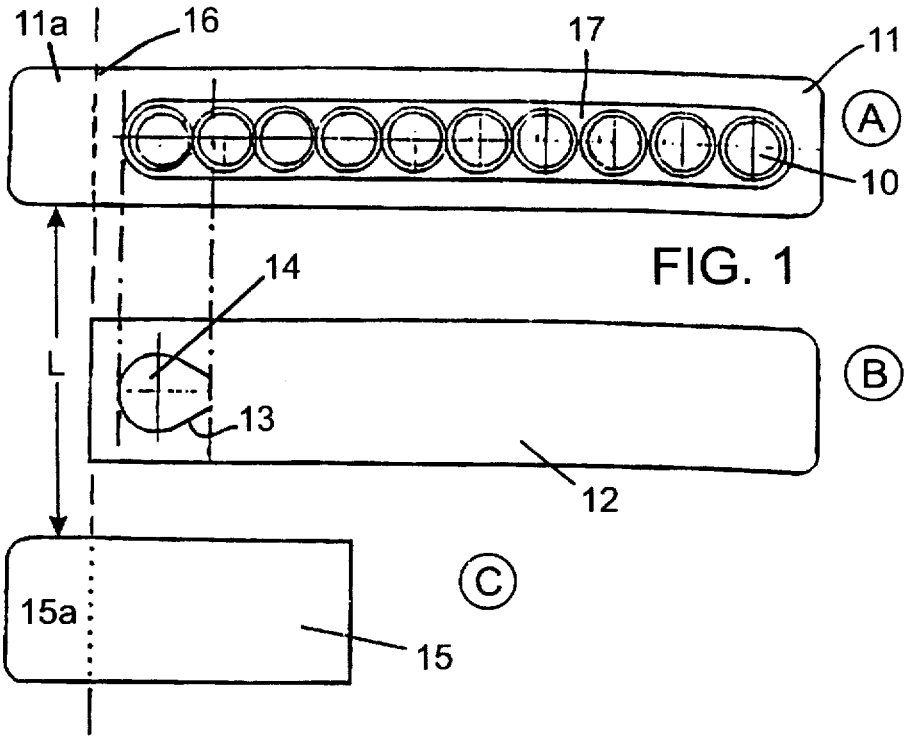
FIG. 1 is a top view of the three components of the packaging in accordance with the invention.

The packaging, represented in FIG. 1 in its components, first consists of an elongated deep-drawn element 11, into which a straight deep-drawn groove 17 has been cut in which the pellet-like products, tablets in this case, have been housed in rows in the manner of a magazine.

At its one end (the left one in the drawing figure), the deep-drawn element 11 has an edge section 11*a*, which can be released by breaking a break-off edge 16 off the deep-drawn element 11 (FIG. 1A). Since the breaking-open of the break-off edge 16 is irreversible, these characteristics are used to represent an "anti-tampering closure", i.e. a package, once opened, can be immediately recognized as such, which is very important, particularly with pharmaceutical products.

Figure 2:
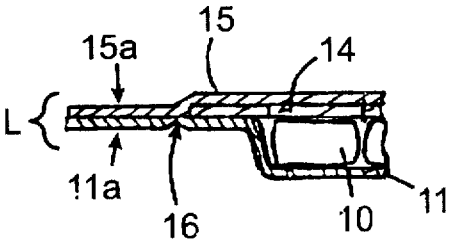
FIG. 2 is a partially cut representation of the packaging in the closed state.

The second component of the packaging is a cover foil 12, whose size essentially corresponds to the exterior size of the deep-drawn element 11 with the exception that the one end (the left one in the drawing) only extends as far as the break-off edge 16 of the deep-drawn element. A perforation line or stamping line 13 has been cut into the cover foil 12, which defines a flap 14. This perforation line 13 or the flap 14 is disposed in the cover foil 12 in such a way that, when it is applied to the deep-drawn element (FIG. 2), it comes to lie over the left tablet within the deep-drawn groove 17, and it is of such size, that when the flap 14 is opened, only this one tablet can be easily removed from the deep-drawn element 11. The cover foil 12 is sealed on the deep-drawn element 11 in a known manner or it can be glued together with it.

An adhesive foil 15 is provided as the third part of the novel packaging (FIG. 1C), which extends over the flap 14 in the cover foil 12 and the separable edge section 11*a* of the deep-drawn element 11, wherein the left end section 15*a* of the adhesive foil 15 and the separable edge section 11*a* of the deep-drawn element 11 form an opening tongue L.

Figure 3:
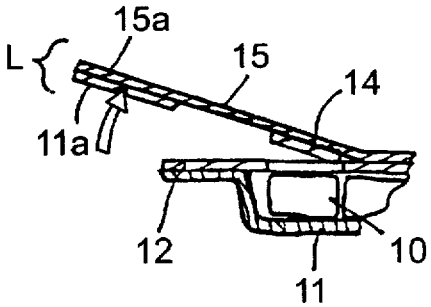
FIG. 3 is a partially cut representation of the packaging in the open state.

In the closed state of the packaging (FIG. 2), the opening tongue L thus constitutes a more or less rigid component of the packaging and indicates to the user that the packaging had not yet been opened. If a packaged product 10 is to be removed for the first time, the opening tongue L is pulled upward, separating the edge section 11*a* of the deep-drawn element 11 (FIG. 3), and because of the adhesive effect of the adhesive foil 15 on the cover foil 12 the flap 14 is also pulled upward along the perforation line 13 and thus releases a removal opening corresponding to its size for the pellet-like product 10. It goes without saying that the adhesive force of the adhesive foil 15 must be sufficiently strong in comparison to the perforations of the stamping line 13, so that the remaining bridges of material between the flap 14 and the cover foil 12 can be assuredly broken open.

After removing one or several pellet-like products 10, the packaging can be closed again by again placing the adhesive foil 15 with the flap 14 on the cover foil 12 and by pressing it down, if required. However, it can be easily determined that the packaging had already been opened once, since the edge section 11*a* of the deep-drawn element 11 has been separated from the latter.

In the described first exemplary embodiment of the packaging a deep-drawn conduit 17 has been provided, however, it is easily possible (FIG. 5) to design the packaging in such a way, that several deep-drawn conduits 17A . . . 17C are disposed next to each other in a common packaging, wherein it is usefully possible by means of suitable stamping lines P1, P2, to separate such packagings into individual packagings in accordance with FIGS. 1 to 4.

For providing the magazine effect it is also not absolutely necessary to embody the deep-drawn conduit 17 continuously in the form of a groove, as long as it is assured that always only one pellet-like product 10 (tablet) is kept ready for removal underneath the flap 14. Plastics, such as polypropylene or polyester are used as materials for the packaging, which assure sufficient sealing, which is also easily obtainable during the sealing-on or gluing of the deep-drawn element with the cover foil.

I claim:

1. Packaging for storing products in the form of pellets, said packaging comprising:

a deep-drawn element having a plurality of straight deep-drawn grooves, each groove having an open top and being dimensioned to hold a plurality of the products in a row; and a cover element covering said deep-drawn element and the open tops of said grooves, said cover element having a plurality of closable removal openings each aligned with a portion of the open top of a respective one of said grooves, each said closable removal opening being openable for removal of successive ones of the products held in the respective one of the said grooves, wherein said cover element comprises: a cover foil provided with a plurality of flaps, each of said flaps delimiting a respective one of said removal openings, and each of said flaps being surrounded by a respective portion of said cover foil; and an adhesive foil, having a plurality of portions, each of said adhesive foil portions covering, and secured to, a respective one of said flaps and covering the respective portion of said cover foil which surrounds the respective one of said flaps, each of said adhesive foil portions being movable between a closing position for causing said adhesive foil portion and the respective one of said flaps to tightly seal the respective one of said removal openings and an opening position for opening the respective one of said removal openings.

2. Packaging in accordance with claim 1 wherein said deep-drawn element has a plurality of separable edge sections each disposed adjacent one end of a respective one of said deep-drawn grooves, and said adhesive foil has a plurality of end sections each connected to a respective one of said adhesive foil portions and to a respective one of said separable edge sections, each of said end sections forming with the respective one of said separable edge sections a respective opening tongue which is movable to separate the respective one of said separable edge sections from said deep-drawn element and to move the respective one of said adhesive foil portions to the opening position.

3. Packaging in accordance with claim 2 wherein said deep-drawn element has a plurality of break-off edges, each located between a respective one of said plurality of separable edge sections and the adjacent end of a respective one of said deep-drawn grooves, for facilitating initial separation of each of said separable edge sections from said deep-drawn element.

4. Packaging in accordance with claim 2, wherein said packaging is constituted by a plurality of individual packaging units each having a respective one of said deep-drawn grooves, and said packaging is provided with stamping lines for permitting the individual packaging units to be separated from one another.

5. Packaging in accordance with claim 1, wherein said packaging is constituted by a plurality of individual packaging units each having a respective one of said deep-drawn grooves, and said packaging is provided with stamping lines for permitting the individual packaging units to be separated from one another.

6. Packaging in accordance with claim 1 wherein said deep-drawn grooves lie parallel to one another.

7. Packaging in accordance with claim 1, wherein the deep-drawn element (11), the cover foil (12) and the adhesive foil (15) consist of mutually recyclable materials.

* * * * *